US007549815B2

(12) United States Patent
Wong

(10) Patent No.: US 7,549,815 B2
(45) Date of Patent: Jun. 23, 2009

(54) APPARATUS OR METHOD FOR APPLYING A SOLVENT

(76) Inventor: Hammond Wong, 2843 Trish Way, West Covina, CA (US) 91792

( * ) Notice: Subject to any disclaimer, the term of this patent is extended or adjusted under 35 U.S.C. 154(b) by 159 days.

(21) Appl. No.: 11/753,714

(22) Filed: May 25, 2007

(65) Prior Publication Data

US 2008/0250592 A1 Oct. 16, 2008

Related U.S. Application Data

(63) Continuation-in-part of application No. 11/362,497, filed on Feb. 24, 2006.

(51) Int. Cl.
*B43K 5/14* (2006.01)
*A46B 11/04* (2006.01)

(52) U.S. Cl. ..... 401/134; 401/133; 401/272

(58) Field of Classification Search ..... 401/202, 401/213, 262, 269, 183–186, 132–135, 272
See application file for complete search history.

(56) References Cited

U.S. PATENT DOCUMENTS 1,420,581 A * 6/1922 Schoneman ..... 401/124
4,176,980 A * 12/1979 O'Neal et al. ..... 401/162
4,722,449 A 2/1988 Dubach ..... 215/235
4,898,293 A 2/1990 Morel ..... 215/250
4,925,327 A 5/1990 Wirt ..... 401/205
4,976,379 A 12/1990 Sloan ..... 222/83
5,255,813 A 10/1993 Berggren et al. ..... 220/278
6,439,789 B1 8/2002 Ballance et al. ..... 401/134
6,450,724 B1 * 9/2002 Cambio ..... 401/270
6,488,665 B1 12/2002 Severin et al. ..... 604/200
6,758,376 B1 7/2004 Clodfelter et al. ..... 222/520

* cited by examiner

*Primary Examiner*—David J Walczak
(74) *Attorney, Agent, or Firm*—Walter J. Tencza, Jr.

(57) ABSTRACT

An apparatus including a cover, a foam housing, a pushing cap, a container, and a seal. The container may be adaptable for retaining a solvent, and the combination of the seal and the container may retain the solvent in a completely enclosed chamber. The seal may prevent the solvent from coming out of the container unless the seal is broken. The cover may be oriented with respect to the pushing cap so that when the cover is pressed in a first direction, the pushing cap moves in the first direction, and snaps into a first position on the container while breaking the seal, and allows the solvent to come out of the container and out of the foam housing.

12 Claims, 16 Drawing Sheets

APPARATUS OR METHOD FOR APPLYING A SOLVENT

CROSS REFERENCE TO RELATED APPLICATION(S)

The present application is a continuation in part of and claims the priority of U.S. patent application Ser. No. 11/362,497, titled "APPARATUS OR METHOD FOR APPLYING A SOLVENT", filed on Feb. 24, 2006.

FIELD OF THE INVENTION

This invention relates to improved methods and apparatus concerning devices for applying a solvent.

BACKGROUND OF THE INVENTION

There are various devices known in the prior art for applying a solvent. U.S. Pat. No. 4,722,449 to Dubach, discloses a container closure with a hinged cap and seal piercing means. The container closure can adopt a higher position on the container neck in which a membrane seal remains intact or a lower position on the container neck in which the membrane is pierced to allow access to the container contents. (Dubach, col. 2, lns. 7-14).

SUMMARY OF THE INVENTION

In one embodiment, the present invention provides an apparatus comprising a cover, a foam housing, a pushing cap, a container, and a seal. The container may be adaptable for retaining a solvent, and the combination of the seal and the container may retain the solvent in a completely enclosed chamber. The seal may prevent the solvent from coming out of the container unless and until the seal is broken.

The cover may be oriented with respect to the pushing cap so that when the cover is pressed in a first direction, the pushing cap moves in the first direction, snaps into a first position on the container while breaking the seal and allows the solvent to come out of the container, go into the foam housing, and subsequently to be applied from the foam housing. The cover typically can be separated from the pushing cap by pulling the cover away from the pushing cap, in a second direction which is opposite the first direction.

The pushing cap may have a pointed section which breaks the seal when the pushing cap moves in the first direction. The pointed section may be located substantially in the center of the pushing cap. The pointed section may be surrounded by one or more openings through which the solvent can pass to go from the container to the foam housing.

In one embodiment of the present invention, a method is disclosed including placing a solvent into a container through an opening and sealing the opening with a seal, such that the solvent is contained within a completely enclosed chamber. The method may further include placing a pushing cap on the container, placing a foam housing on the pushing cap, and placing a cover over the foam housing. The cover is oriented with respect to the pushing cap so that when the cover is pressed in a first direction, the pushing cap moves in the first direction, snaps into a first position on the container while breaking the seal, allowing the solvent to come out of the container and out of the foam housing.

DETAILED DESCRIPTION OF THE DRAWINGS

Figure 1:
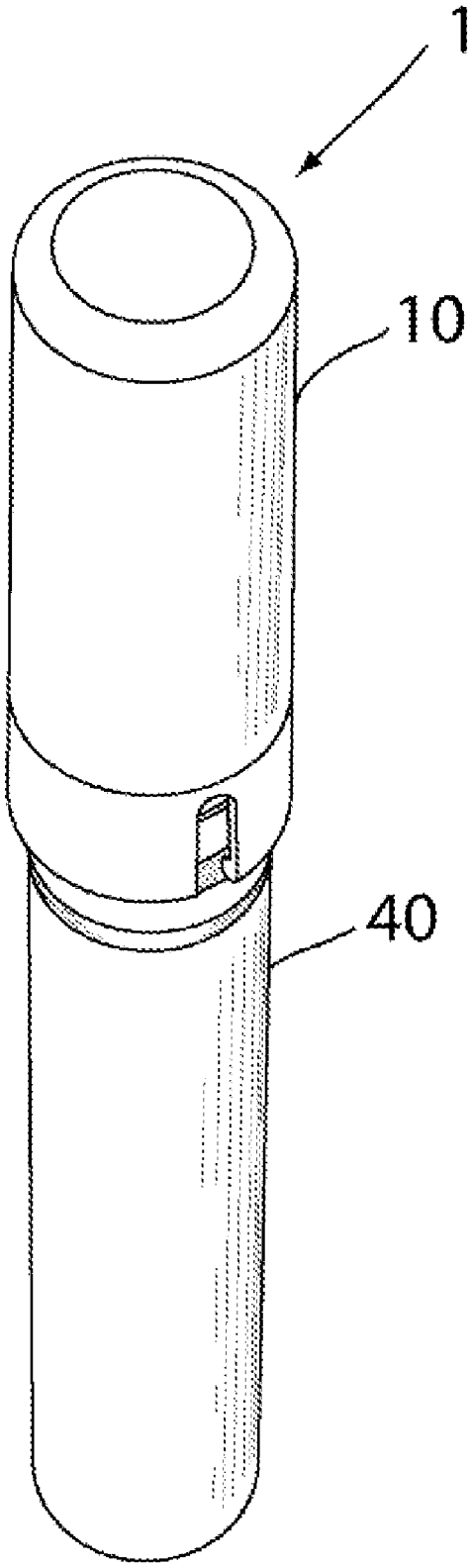
FIG. 1 shows a top perspective view of an apparatus for applying a solvent.
Figure 2:
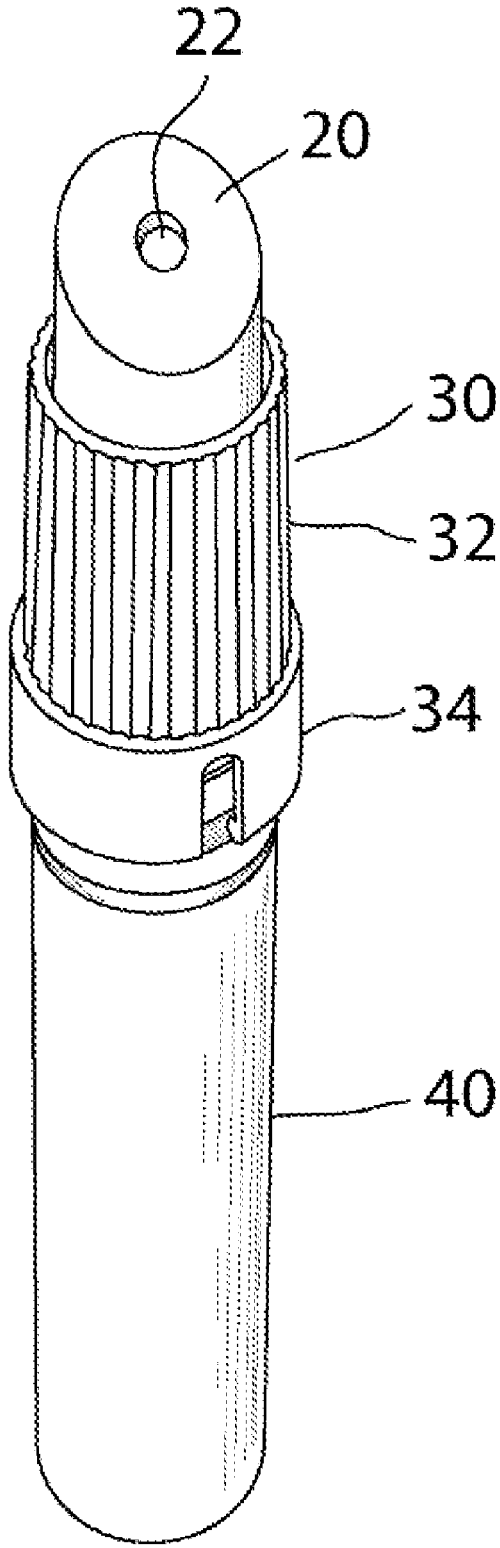
FIG. 2 shows a top perspective view of part of the apparatus of FIG. 1.

FIG. 1 shows a top perspective view of an apparatus 1 for applying a solvent. FIG. 2 shows a top perspective view of part of the apparatus 1. Referring to FIGS. 1 and 2, the apparatus 1 includes a cover 10, a foam housing 20, a pushing cap 30, and a bottle or container 40.

Figure 3:
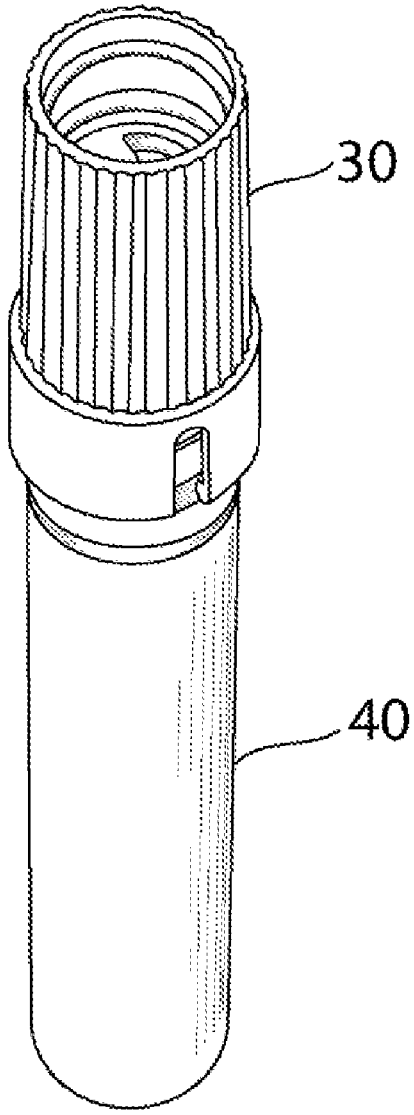
FIG. 3 shows a top perspective view of pushing cap and a bottle for use with the apparatus of FIG. 1.
Figure 4:
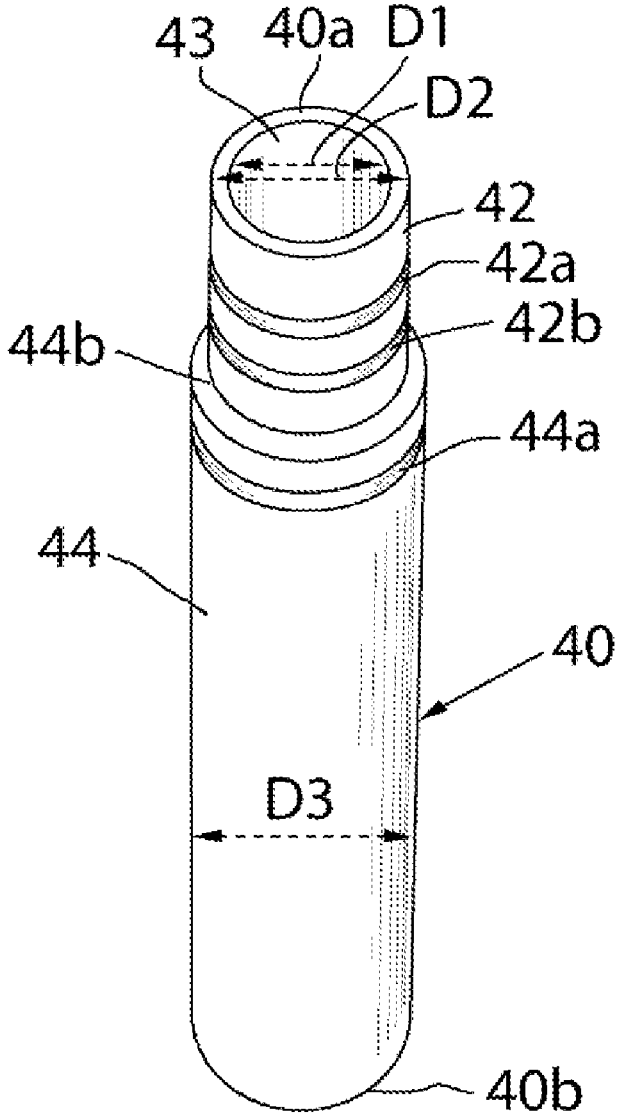
FIG. 4 shows a top perspective view of a bottle for use with the apparatus of FIG. 1.

FIG. 3 shows a top perspective view of the pushing cap 30 located on the bottle 40. FIG. 4 shows a top perspective view of the bottle or container 40. Referring to FIG. 4, the bottle 40 includes a first or top section 42 and a second or bottom section 44. The top section 42 and the bottom section 44 may each be substantially shaped in the form of a hollow cylinder. The top section 42 may have an opening 43. The top section 42 may have (either ridges or) indentations 42*a* and 42*b* which are used to lock inner ridge (or indentation) 35*a* of the pushing cap 30 into either the position shown in FIG. 11A or the position shown in FIG. 11C. The bottom section 44 may have a ridge or indentation 44*a*. The top section 42 may have an inner diameter D1 and a outer diameter D2. The bottom section 44 may have an outer diameter D3 and an inner diameter, not shown in FIG. 4, which may be equal to the inner diameter D1 of the top section 42. There is a shoulder 44*b* at a location where the top section 42 is joined or is integrated with the bottom section 44.

Figure 5:
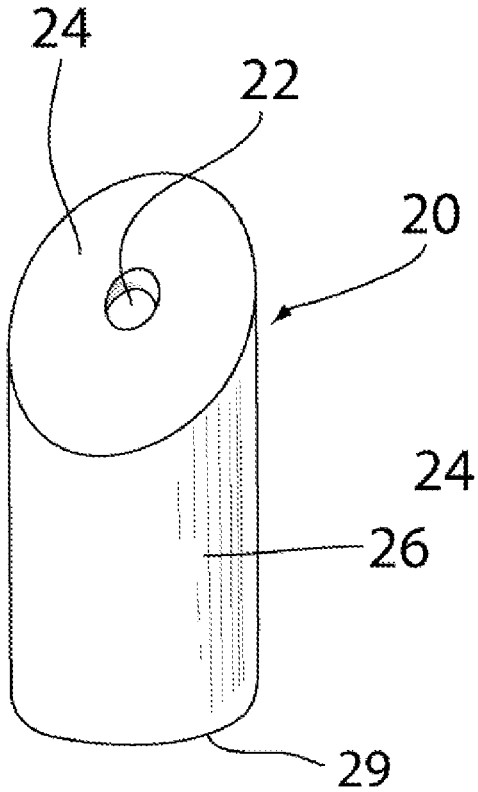
FIG. 5 shows a top perspective view of a foam housing for use with the apparatus of FIG. 1.
Figure 6:
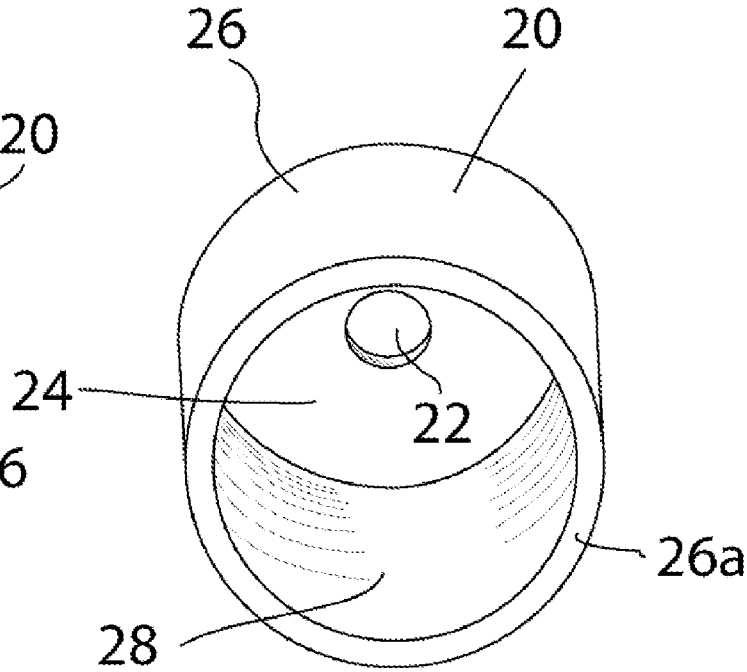
FIG. 6 shows a bottom perspective view of the foam housing of FIG. 5.

FIG. 5 shows a top perspective view of a foam housing 20 for use with the apparatus 1. FIG. 6 shows a bottom perspective view of the foam housing 20. The foam housing 20 has a top opening 22, an inclined top surface 24, a peripheral wall 26, and a bottom opening 28. The foam housing 20 is substantially cylindrical with the exception of the inclined top surface 24. The foam housing 20 may be made of foam or sponge material. In addition or alternatively, a layer of foam may cover the foam housing 20 or bristles may be implanted on the inclined top surface 24 of the foam housing 20. The bristles may be similar to bristles found on a toothbrush.

Figure 7:
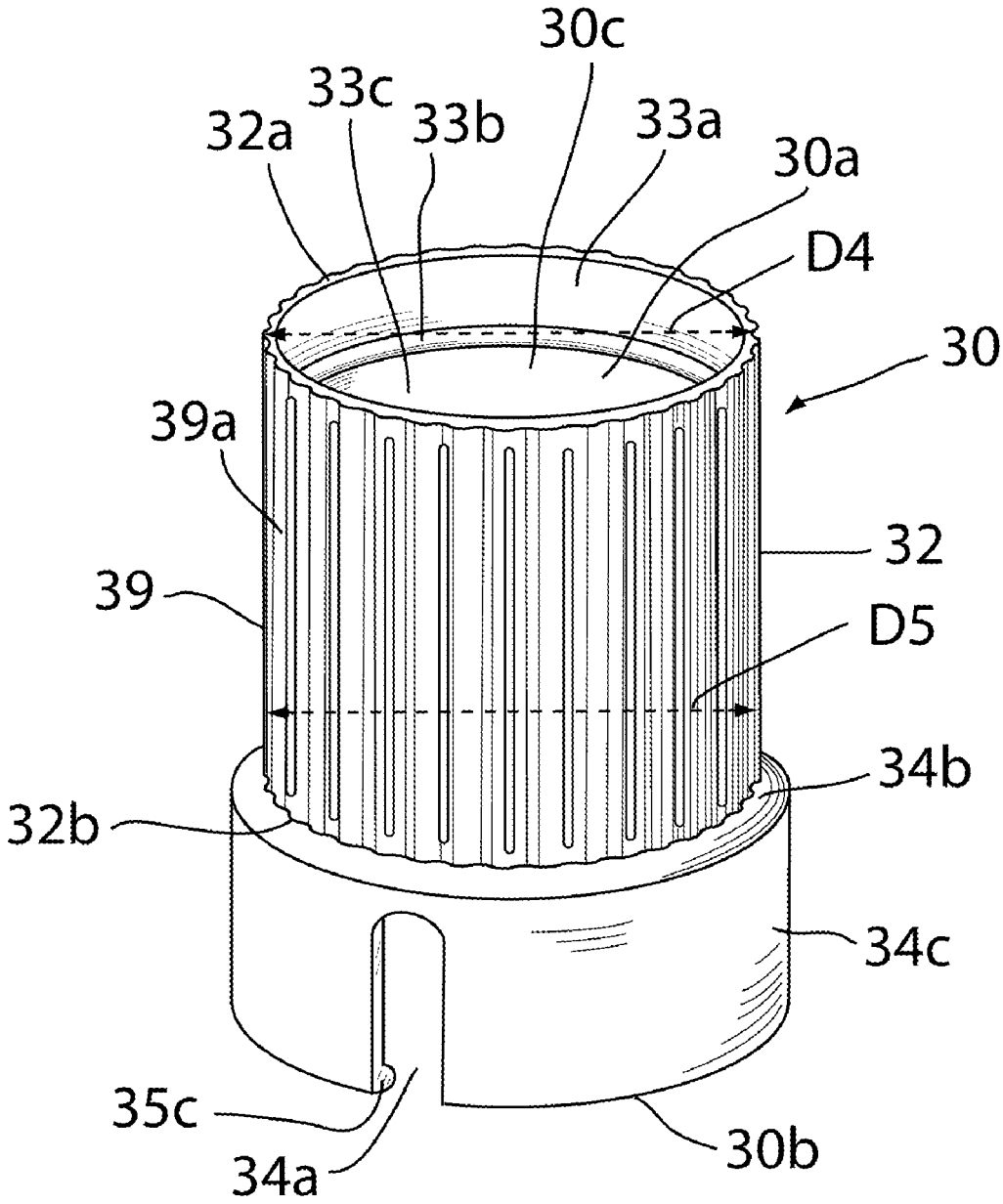
FIG. 7 shows a top perspective view of the pushing cap of FIG. 3.
Figure 8:
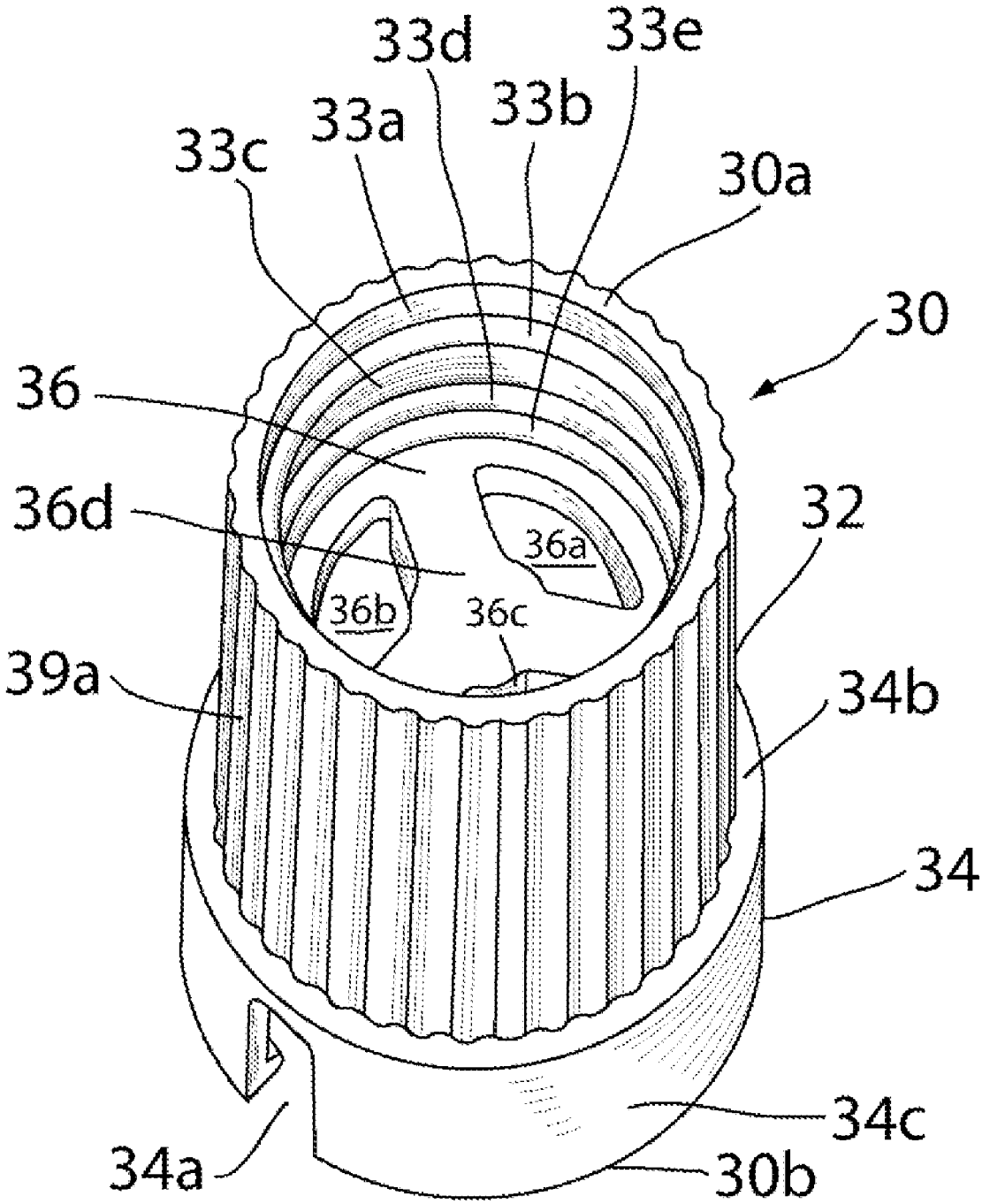
FIG. 8 shows a top perspective view of the pushing cap of FIG. 3, from a top perspective different than shown in FIG. 7.
Figure 9:
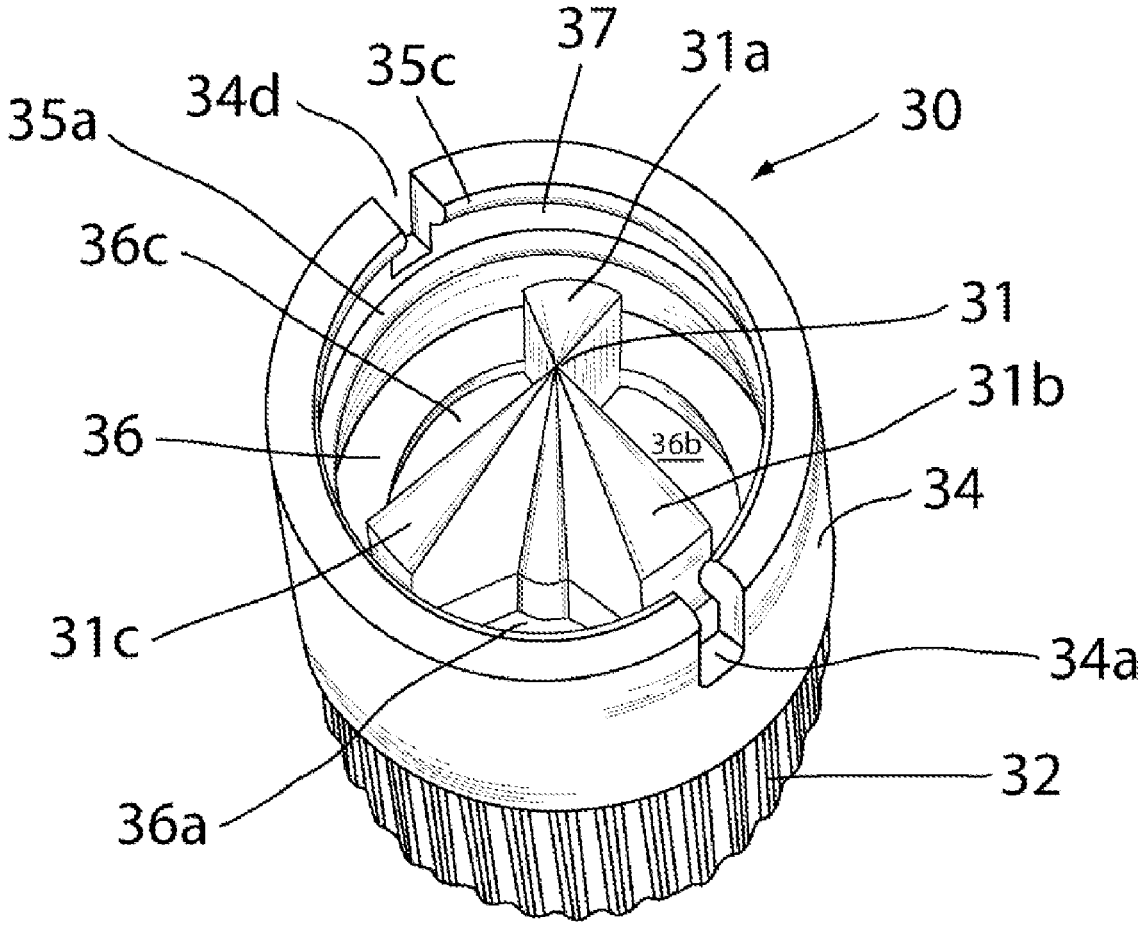
FIG. 9 shows a bottom perspective view of the pushing cap of FIG. 3.
Figure 10:
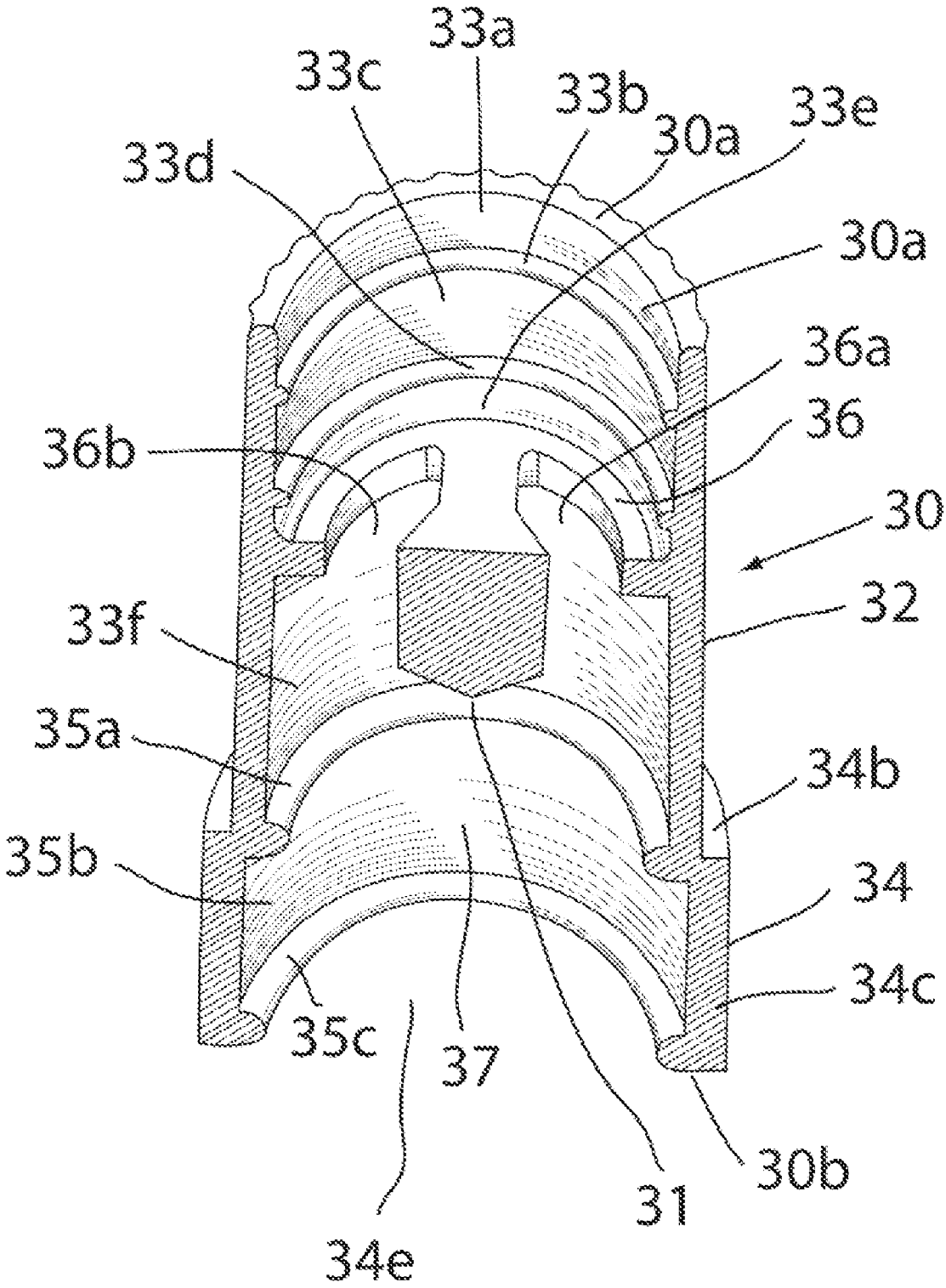
FIG. 10 shows a cross sectional view of the pushing cap of FIG. 3.

FIG. 7 shows a top perspective view of the pushing cap 30. FIG. 8 shows a top perspective view of the pushing cap 30, from a top perspective different than shown in FIG. 7. FIG. 9 shows a bottom perspective view of the pushing cap 30. FIG. 10 shows a cross sectional view of the pushing cap 30. The pushing cap 30 includes top portion or section 32 and bottom portion or section 34.

Referring to FIGS. 7-10, the top section 32 has a plurality of substantially uniformly spaced ridges 39, such as ridge 39*a*, which are for tightening the cover 10. The top section 32 has a top opening 30*a*, leading to an inner chamber 30*c* The inner chamber 30*c* is surrounded by a inner wall 33*a*, an inner ridge 33*b*, an inner wall 33*c*, an inner ridge 33*d*, and an inner wall 33*e*. There is a disc 36 fixed inside the chamber 30*c* of the pushing cap 30. The disc 36 has openings 36*a*, 36*b*, and 36*c*, which may have the same shape, such as triangular, trapezoidal, arcuate, or any other shape. The top section 32 also includes an inner wall 33*f*, a portion of which is shown in FIG. 10.

The bottom section 34 includes an opening or gap 34*a*, a shoulder 34*b*, and an outer wall 34*c*, as shown in FIG. 7. The purpose of opening or gap 34*a* is to allow room for expansion of the bottom section 34 when the pushing cap 30 is pressed down in the direction D1 as shown in FIGS. 11A-B. The bottom section 34 has an opening 34*e*, which leads to an inner chamber 37. The inner chamber 37 is surrounded by an inner ridge (or indentation) 35*a*, an inner wall 35*b*, and an inner ridge (or indentation) 35*c* as shown by FIG. 10.

FIG. 9 shows a bottom perspective view of the pushing cap 30 of FIG. 3. FIG. 9 shows the inner ridges (or indentations) 35*a* and 35*c*, a pointed section 31, protruding sections 31*a*, 31*b*, and 31*c*, openings 36*a*, 36*b*, and 36*c*, gap 34*d*, an inner wall or surface 37, bottom section 34, gap or opening 34*a*, and part of top section 32.

FIG. 11A shows a cross sectional view of the apparatus 1 in a first state. In the first state of FIG. 11A, the cover 10 covers the foam housing 20 and an edge 10*a* of the cover 10 rests on the shoulder 34*b* of the bottom section 34 of the pushing cap 30. In FIG. 11A, the bottom or bottom edge 30*b* of the pushing cap 30 rests on the shoulder 44*b* of the container 40. The container 40 has an inner chamber 49 within the section 44, within which is located a solvent 50, which is typically in liquid, gel or paste form. The solvent 50 is located up to a level 50*a*. The solvent 50 is completely enclosed in the sealed inner chamber 49 when a seal 52 or foil has not yet been broken.

FIG. 11B shows a cross sectional view of the apparatus 1 in a second state. In the second state of FIG. 11B, the cover 10 has been pushed downwards in a direction D1. Pushing the cover 10 down in the direction D1 causes the edge 10*a* to push on the shoulder 34*b* causing the pushing cap 30 to move downward in the direction D1. As the pushing cap 30 moves downward, the edge 30*b* goes past the shoulder 44*b* of the container 40. The foam housing 20 has a bottom edge 26*a*, which rests on the surface 36*d*, shown in FIGS. 8 and 11B, of the disc 36 and thus the foam housing 20 moves downward in the direction D1, with the movement of the pushing cap 30. In addition, the central pointed section 31 of the pushing cap 30, deflects the foil or seal 52. Inner ridges 33*b* and 33*d*, partially shown in FIG. 10, act as a double assurance to hold the foam housing 20 firmly in position and prevent the foam housing 20 from falling out of the pushing cap 30.

Figure 11C:
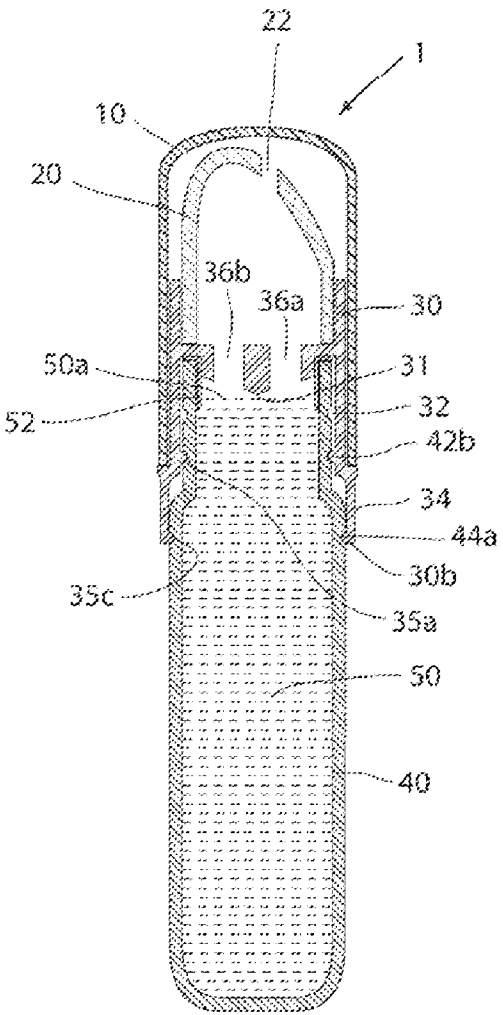
FIG. 11C shows a cross sectional view of the FIG. 1 apparatus in a third state.
Figure 11B:
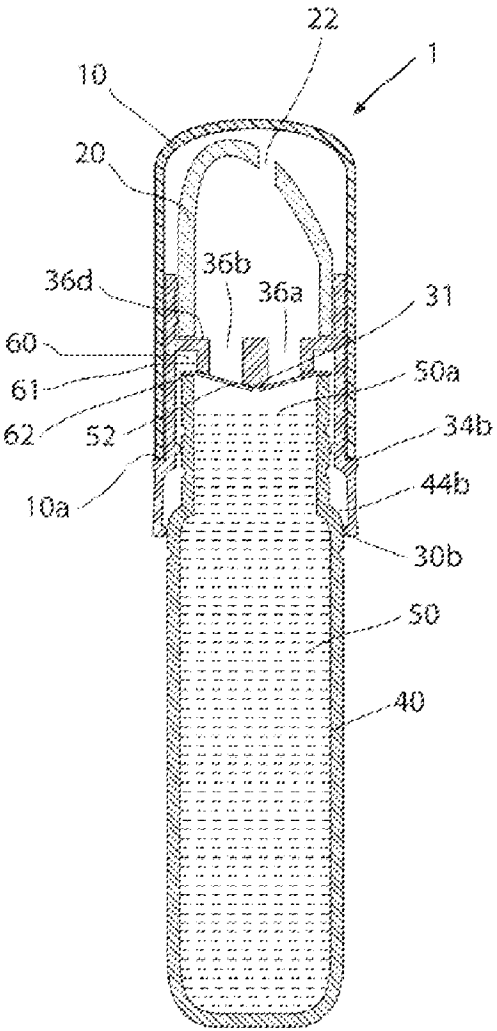
FIG. 11B shows a cross sectional view of the FIG. 1 apparatus in a second state.
Figure 11A:
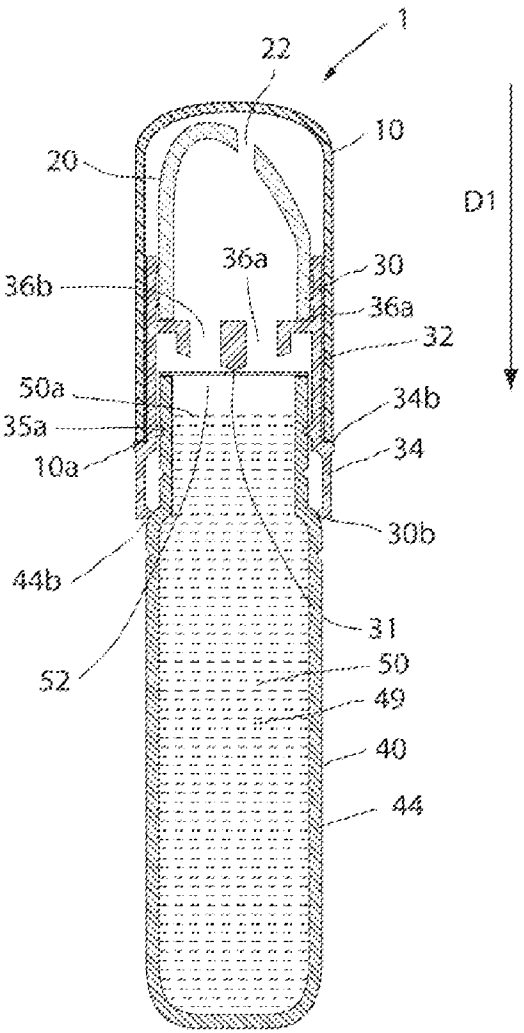
FIG. 11A shows a cross sectional view of the FIG. 1 apparatus in a first state.

FIG. 11C shows a cross sectional view of the apparatus 1 in a third state. In the third state of FIG. 11C, the pushing cap 30 has moved further downward in the direction D1 so that the inner ridges (or indentations) 35*c* and 35*a* are now inserted into the indentations (or ridges) 44*a* and 42*b*, respectively, of the container 40. The central pointed section 31 has broken the seal or foil 52. A wall 61, a space 60 and an edge 62 are shown in FIG. 11B. The wall 61 helps to press the broken foil 52 further against the inner wall of the container 40 so as to clear the pass and ensure maximum flow of the solvent through 36*a-c*. The space 60 provides room to accommodate the edge 62 when the pushing cap 30 is pressed down. With the seal or foil 52 broken, the solvent 50 is exposed. The foam housing 20 has moved downward in the direction D1, with the movement of the pushing cap 30 on which it rests.

Figure 11D:
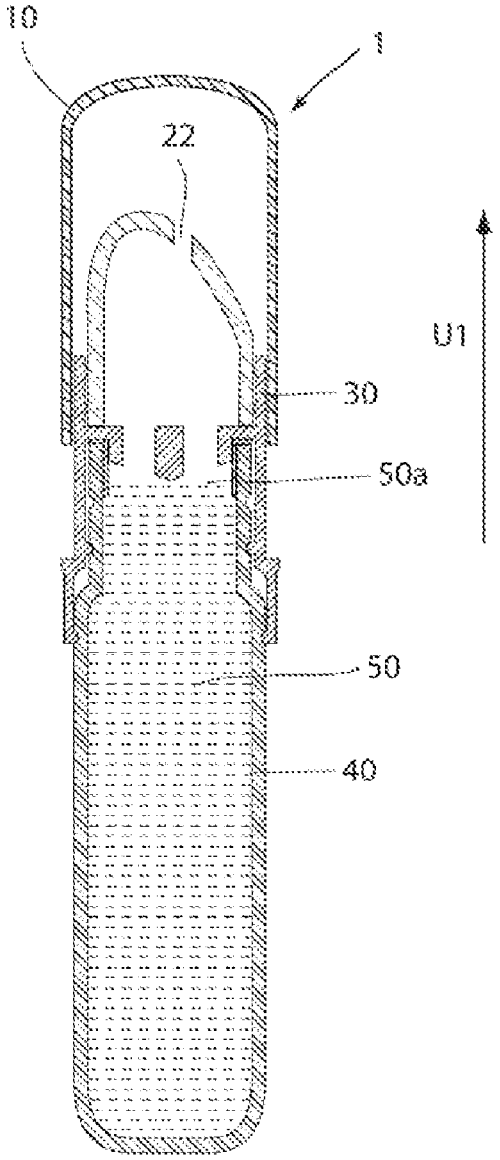
FIG. 11D shows a cross sectional view of the FIG. 1 apparatus in a fourth state.

FIG. 11D shows a cross sectional view of the apparatus 1 in a fourth state. After the pushing cap 30 has been latched as shown in FIG. 11C, the cover 10 can be removed by pulling the cover 10 off upwards in the direction U1, as shown in FIG. 11D. The cover 10 can be pulled off while the pushing cap 30 remains in the position shown in FIG. 11C.

Figure 11E:
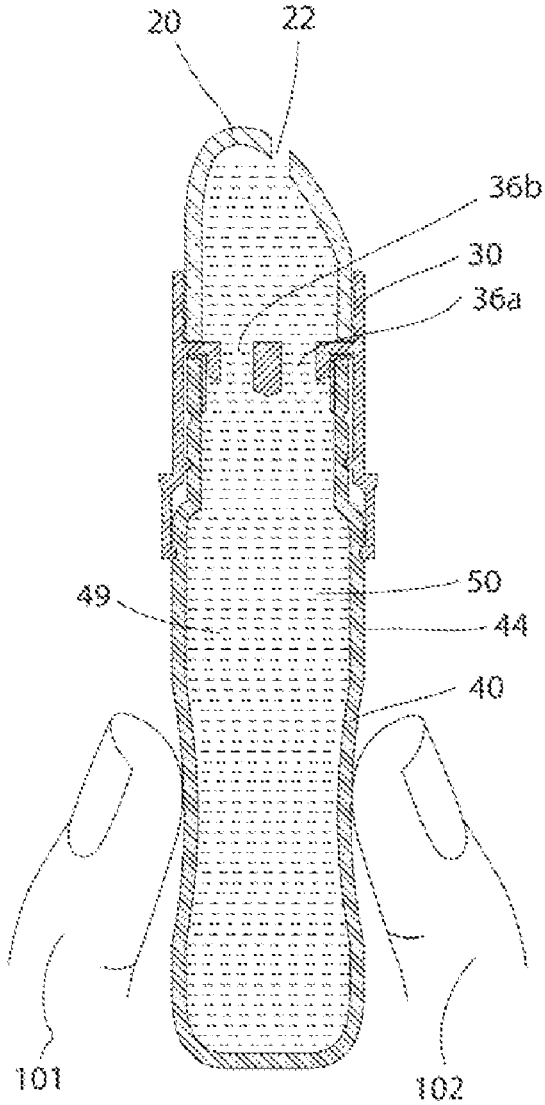
FIG. 11E shows a cross sectional view of a portion of the FIG. 1 apparatus with a bottle or container in a state of compression.

FIG. 11E shows a cross sectional view of a portion of the apparatus 1 with the bottle 40 or container in a state of compression. A person can squeeze the bottle 40 around the portion or section 44 of the bottle the person's fingers 101 and 102. The squeezing causes the solvent 50 to come out of the chamber 49 through openings 36*b*, 36*a*, and 36*c*, in the disc 36 of the pushing cap 30 and flow into the foam housing 20. The solvent 50 then flows out the opening 22 in the foam housing 20. The opening 22 may be two millimeters in diameter. In one embodiment the solvent 50 may seep into the foam housing 20, like a sponge, however, there are other alternatives for applying the solvent.

Figure 12A:
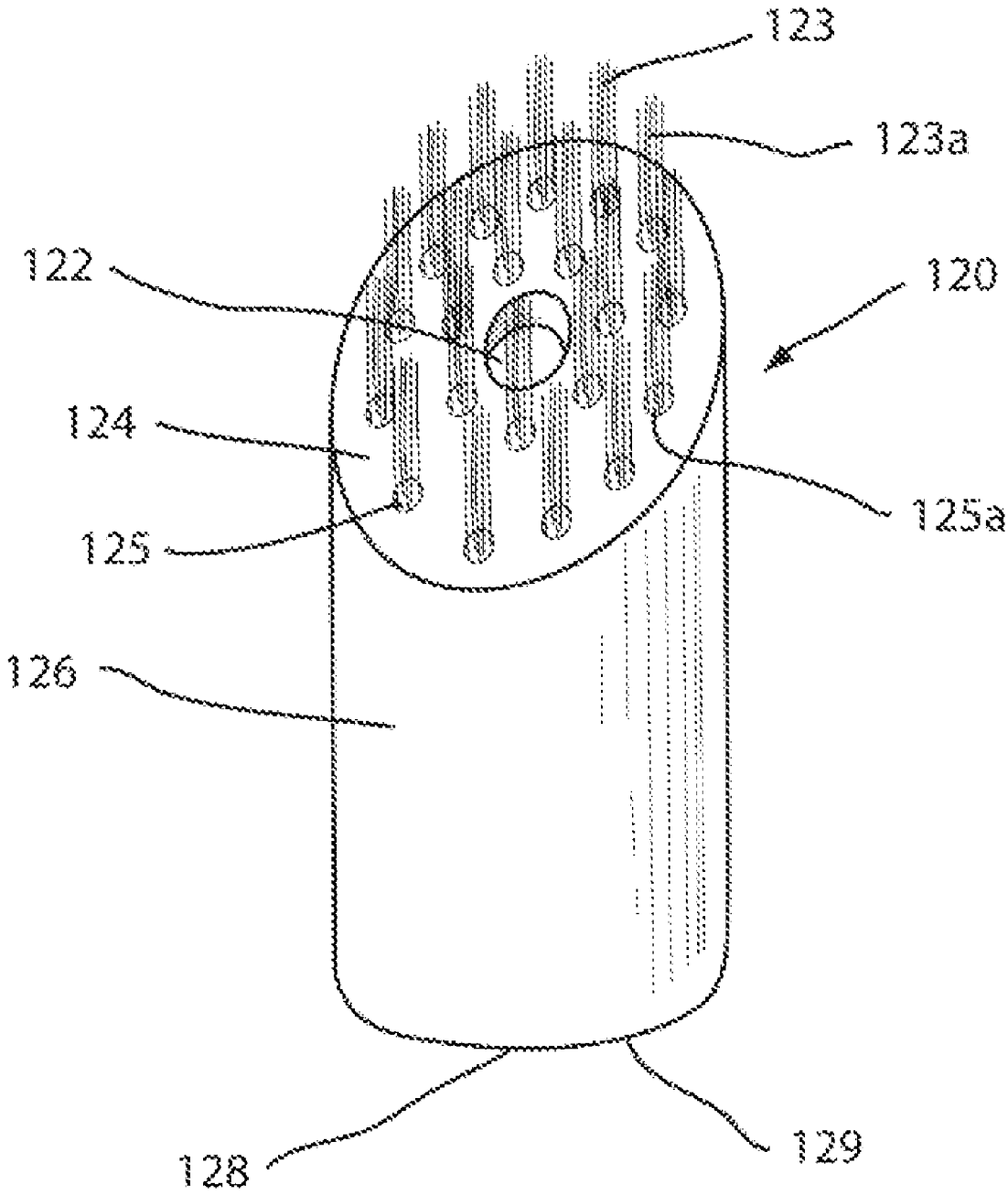
FIG. 12A shows a top perspective view of a housing with bristles which can be used in place of the foam housing of FIG. 5 with the apparatus of FIG. 1.

FIG. 12A shows a top perspective view of a housing 120 with bristles which can be used in place of the foam housing 20 of FIG. 5 with the apparatus 1. The housing 120 has an opening 122 in an inclined top surface 124, a peripheral wall 126, and an opening 128 at a bottom 129 similar to the foam housing 20. The housing 120 also includes a plurality of sets of bristles 123 such as set of bristles 123*a*, which are fixed in a plurality of openings or indentations 125, such as opening or indentation 125*a*. A solvent can be forced through the opening 122 and the sets of bristles 123 can be used to further apply, rub, or smooth out the solvent over any surfaces, including a person's skin or teeth.

Figure 12B:
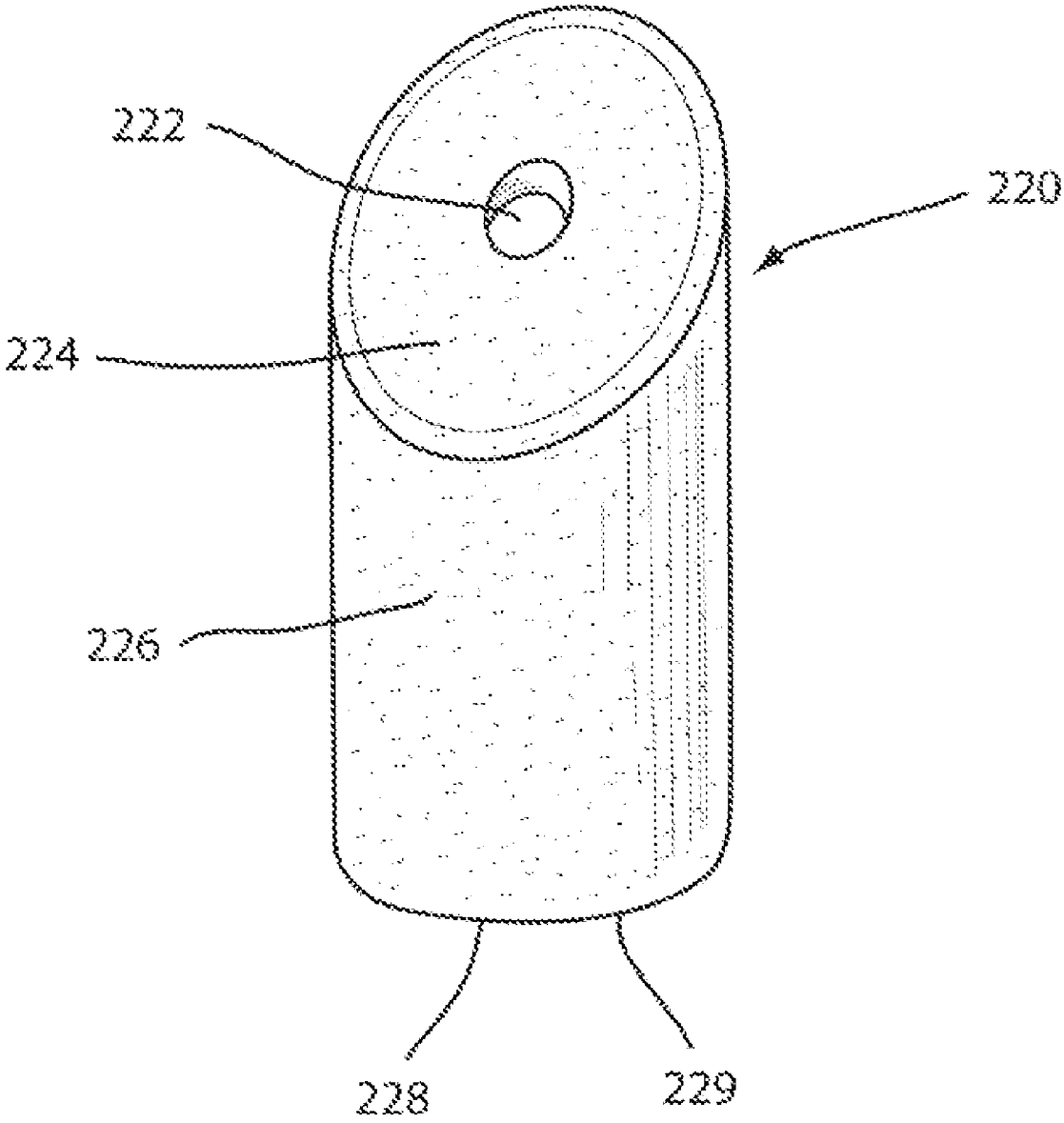
FIG. 12B shows a top perspective view of a housing made of sponge which can be used in place of the foam housing of FIG. 5 with the apparatus of FIG. 1.

FIG. 12B shows a top perspective view of a housing 220 made of sponge which can be used in place of the foam housing 20 of FIG. 5 with the apparatus 1. The housing 220 has an opening 222 in an inclined top surface 224, a peripheral wall 226, and an opening 228 at a bottom 229 similar to the foam housing 20. The inclined surface 224 and the peripheral wall 226 may be comprised of a sponge material so that a solvent may soak into the inclined surface 224 and peripheral wall 226 as well as being applied through the opening 222.

Figure 13:
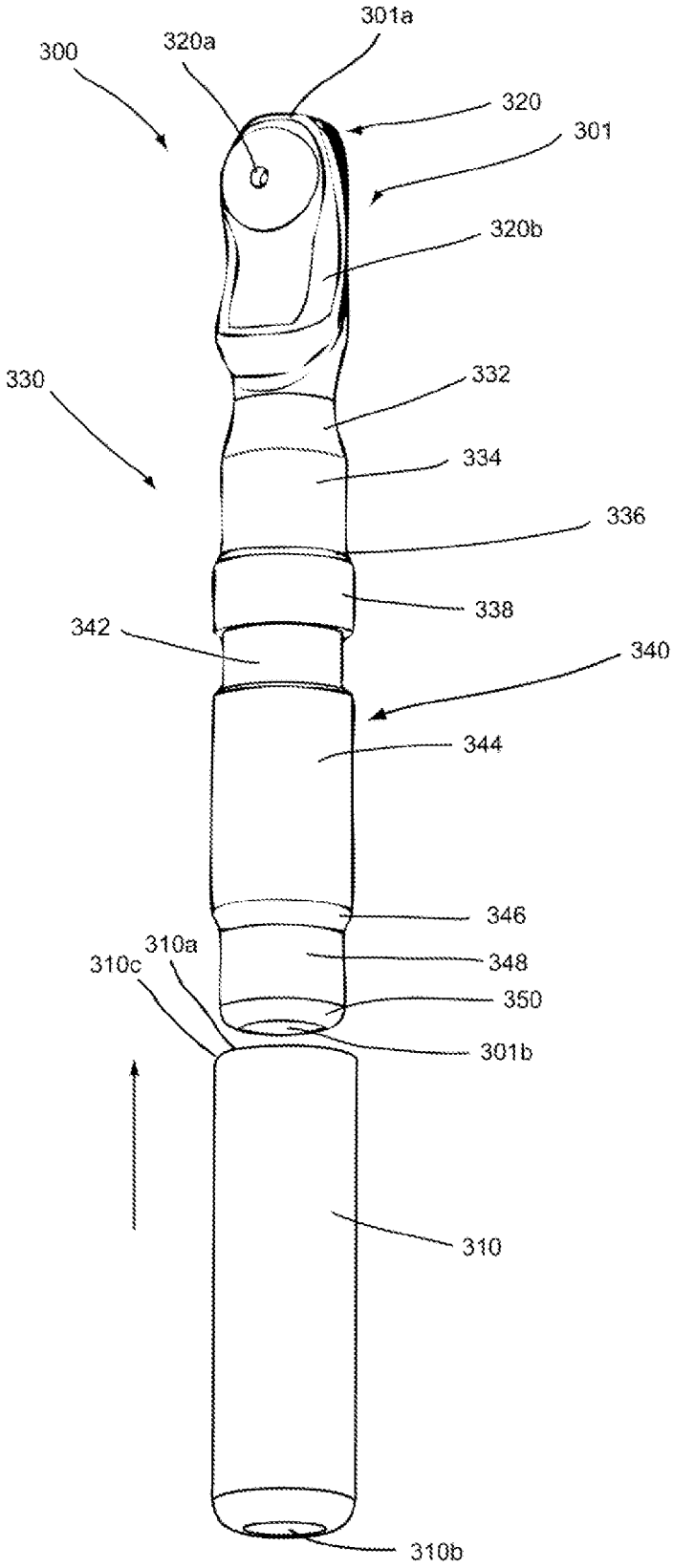
FIG. 13 shows a perspective view of an apparatus and a cover in accordance with another embodiment of the present invention.

FIG. 13 shows a perspective view of an apparatus 300 in accordance with another embodiment of the present invention. The apparatus 300 includes a device 301 and a cover 310. The device 301 is comprised of a head piece or housing 320, a pushing cap 330, and a bottle or container 340. The head piece or housing 320 may be similar in appearance and function to any of the foam housings 20, 120, or 220, shown in FIGS. 2, 12A, and 12B, respectively, with some exceptions. The angle of the foam housings 20, 120, or 120, which may be about forty-five degrees to a person's teeth when brushing, may be hard to use during a teeth "brushing" process. The angle of the head piece or housing 320, may be parallel to a person's teeth when brushing, which may be easier to use.

The pushing cap 330 may be similar in appearance and function to the pushing cap 30 shown in FIG. 2, except that the appearance is slightly different, for aesthetic reasons. The bottle or container 340 may be similar in appearance and function to the bottle or container 40 shown in FIG. 4, with some exceptions. The bottle or container 340 is configured so that the cover 310 can be attached to the section 348 of the container 340. Section 348 may be a circular cylinder having an outer diameter slightly less than the inner diameter of the cover 310 which may be a hollow tube. The cover 310 does not typically extend beyond the section 346. Section 344 may be a circular cylinder having an outer diameter substantially equal to the outer diameter of the cover 310 so that the cover 310 does not extend beyond the section 346.

The head piece 320 may include a hole 320*a* through which a solvent, such as tooth paste or whitening gel can be supplied. The hole 320*a* may be similar in appearance and function to the hole 22 of the foam housing 20 shown in FIG. 2. The head piece 320 includes a foam covering 320*b*.

A solvent may be provided inside an inner chamber, not shown, of the container 340. The inner chamber of the container 340 may be similar to the inner chamber 49 of container 40 shown in FIG. 11A. The solvent may be squeezed out of the inner chamber of the container 340 through opening 320*a* similar to the manner in which a solvent is squeezed out of inner chamber 49 of container 40 as described with reference to FIGS. 11A-11E. The solvent may be a teeth whitener.

The pushing cap 330 includes sections 332, 334, 336, and 338. The container 340 includes sections 342, 344, 346, 348, and 350. The device 301 includes a top end 301*a* at a top of head piece 320 and a bottom end 301*b* at a bottom of section 350. The cover 310 includes a first end 310*a* and a second end 310*b*. An opening 310*c* is located at the first end 310*a*.

Figure 14:
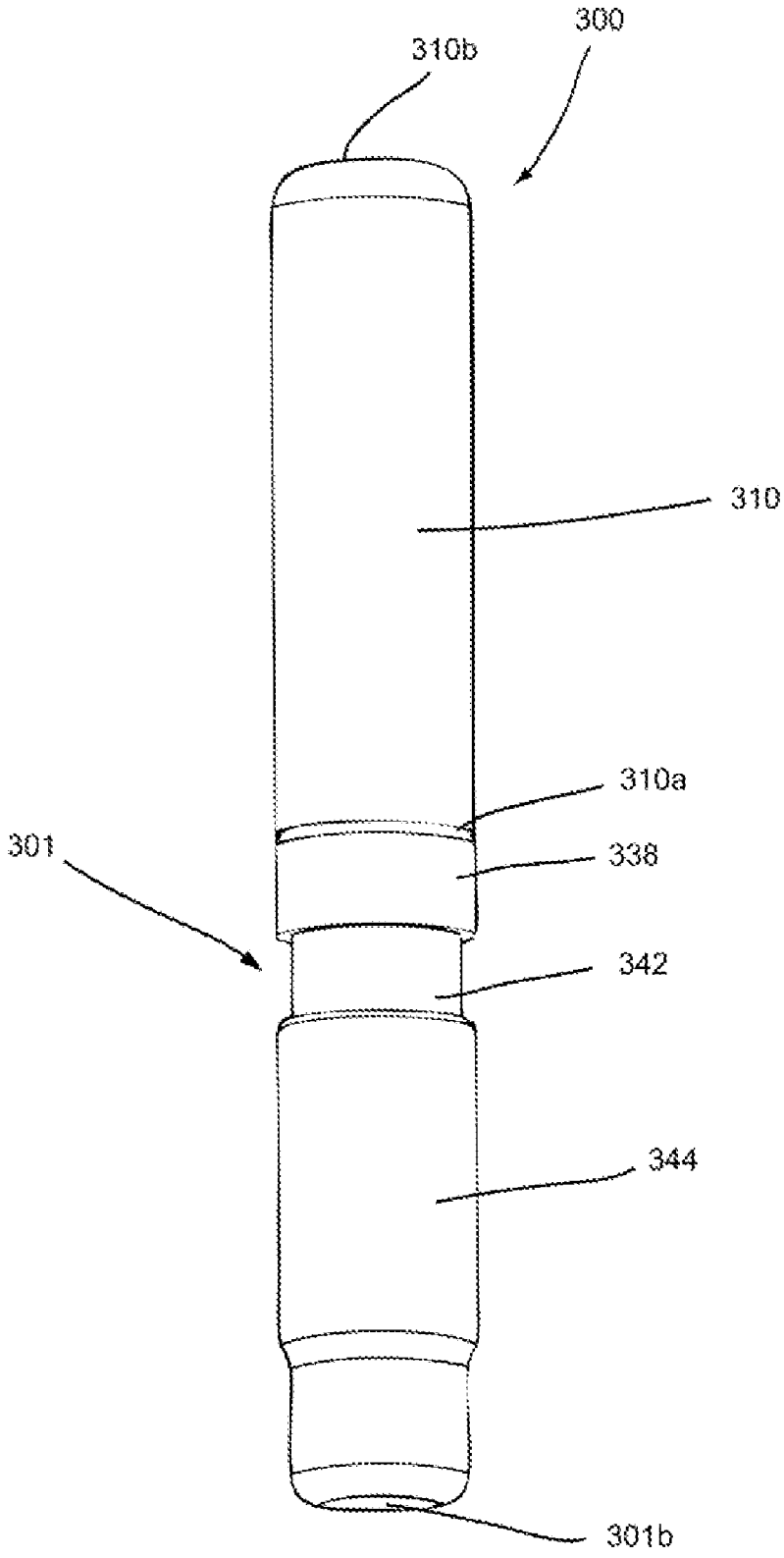
FIG. 14 shows a perspective view of the apparatus of FIG. 13 along with the cover placed on top of the apparatus of FIG. 13.

FIG. 14 shows a perspective view of the device 301 along with the cover 310 placed on top of the device 301. The cover 310 has been placed so that the top end 301*a* of the device 301 has been inserted into the opening 310*c* at end 310*a* of the cover 310. The cover 310 has been slid over part of the device 301 so that the cover 310 covers head piece 320, and sections 332 and 334 of the pushing cap 330.

The cover 310 can also be slid over the bottom end 301*b* of the device 301, so that the end 301*b* is inserted into the opening 310*c* at the end 310*a* of the cover 310. The cover 310 can be slid over the bottom end 301*b* until the cover 310 covers sections 350, and 348, and thereby provides an elongated handle for the device 301 and the apparatus 300.

Section 348 of the container 340, has an outer diameter which is typically slightly less than an inner diameter of the typically circular opening 310*c* of the cover 310, which allows the cover 310 to be placed over the section 350, to act as a handle or to extend the length of a handle including sections 344, 346, 348, and 350.

Figure 15:
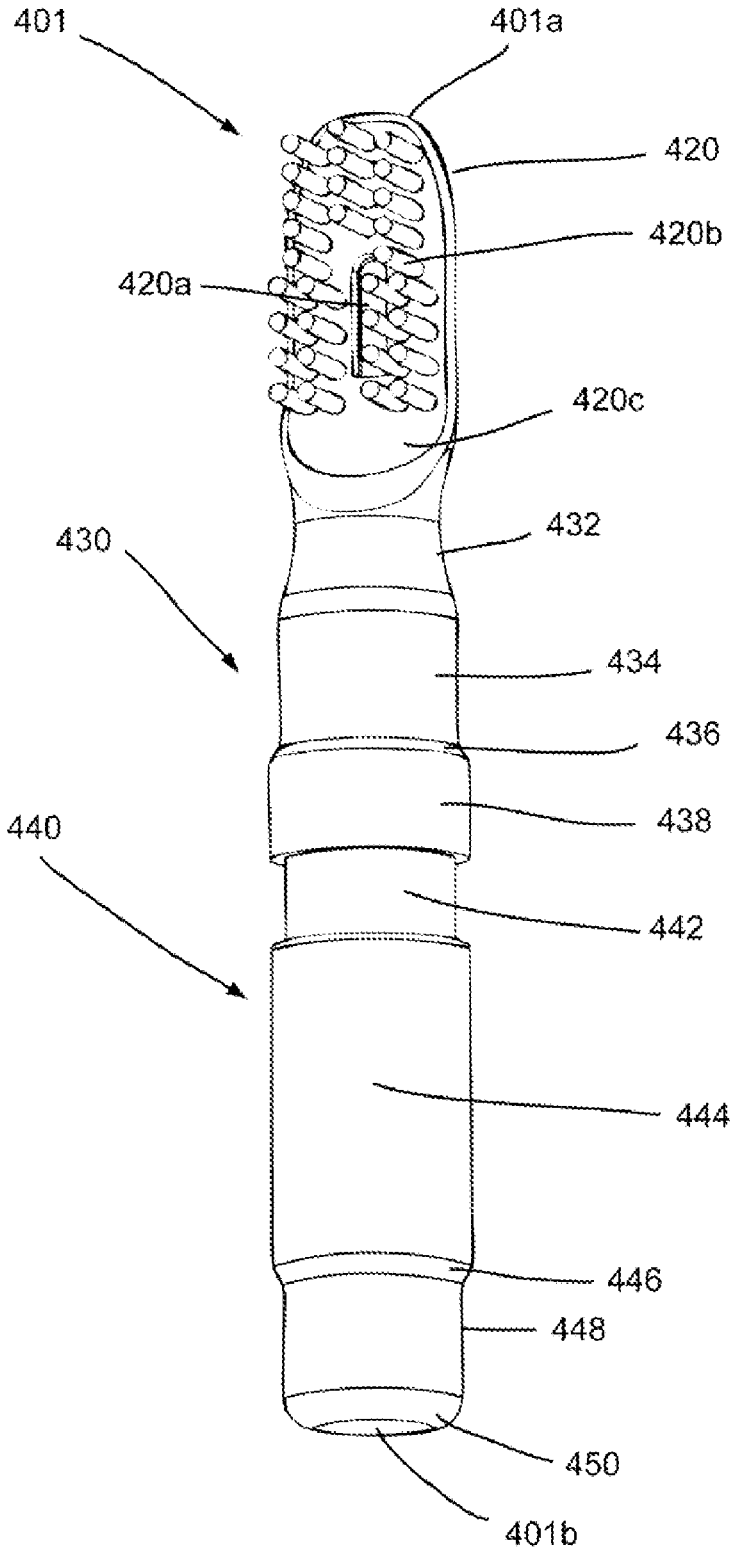
FIG. 15 shows a perspective view of an apparatus in accordance with another embodiment of the present invention.

FIG. 15 shows a perspective view of a device 401 in accordance with another embodiment of the present invention. The device 401 is comprised of a head piece or housing 420, a pushing cap 430, and a bottle or container 440. The head piece or housing 420 may be similar in appearance and function to any of the foam housings 20, 120, or 220, shown in FIGS. 2, 12A, and 12B, respectively, with some exceptions. The angle of the foam housings 20, 120, or 120, which may be about forty-five degrees to the teeth when brushing, may be hard to use during a teeth "brushing" process. The angle of the head piece or housing 420, which may be parallel to the teeth when brushing) may be easier to use.

The pushing cap 430 may be similar in appearance and function to the pushing cap 30 shown in FIG. 2, except it has a different appearance for aesthetic reasons. The bottle or container 440 may be similar in appearance and function to the bottle or container 40 shown in FIG. 4, with some exceptions. The bottle or container 440 is configured so that the cover 310 can be attached to the section 448 of the container 440. Section 448 may be a circular cylinder having an outer diameter slightly less than the inner diameter of the cover 410 which may be a hollow tube. Section 444 may be a circular cylinder having an outer diameter substantially equal to the outer diameter of the cover 310 so that the cover 310 does not extend beyond the section 446.

The head piece 420 may include a hole 420*a* through which a solvent, such as tooth paste or whitening gel can be supplied. The hole 420*a* may be similar in appearance and function to the hole 22 of the foam housing 20 shown in FIG. 2. The head piece 420 includes bristles 420*b*, which are substantially perpendicular to a base 420*c* of the head piece of housing 420.

A solvent may be provided inside an inner chamber, not shown, of the container 440. The inner chamber of the container 440 may be similar to the inner chamber 49 of container 40 shown in FIG. 11A. The solvent may be squeezed out of the inner chamber of the container 440 through opening 420*a* similar to the manner in which a solvent is squeezed out of inner chamber 49 of container 40 as described with reference to FIGS. 11A-11E.

The pushing cap 430 includes sections 432, 434, 436, and 438. The container 440 includes sections 442, 444, 446, 448, and 450. The device 401 includes a top end 401*a* at a top of head piece 420 and a bottom end 401*b* at a bottom of section 450.

Figure 16:
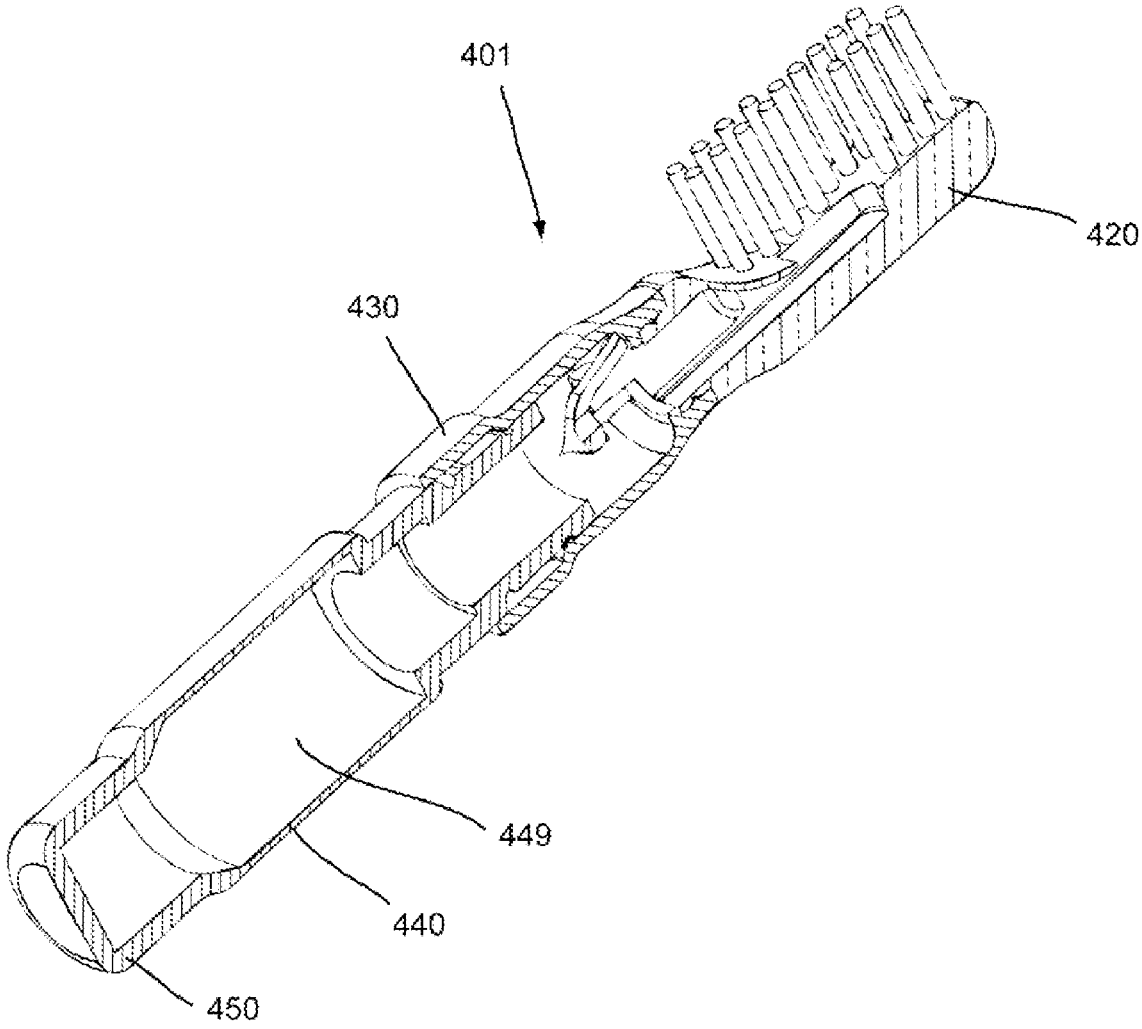
FIG. 16 shows a cross sectional view of the apparatus of FIG. 15.

FIG. 16 shows a cross sectional view of the device 401 of FIG. 15. FIG. 16 shows the inner chamber 449 of the container 440.

Figure 17:
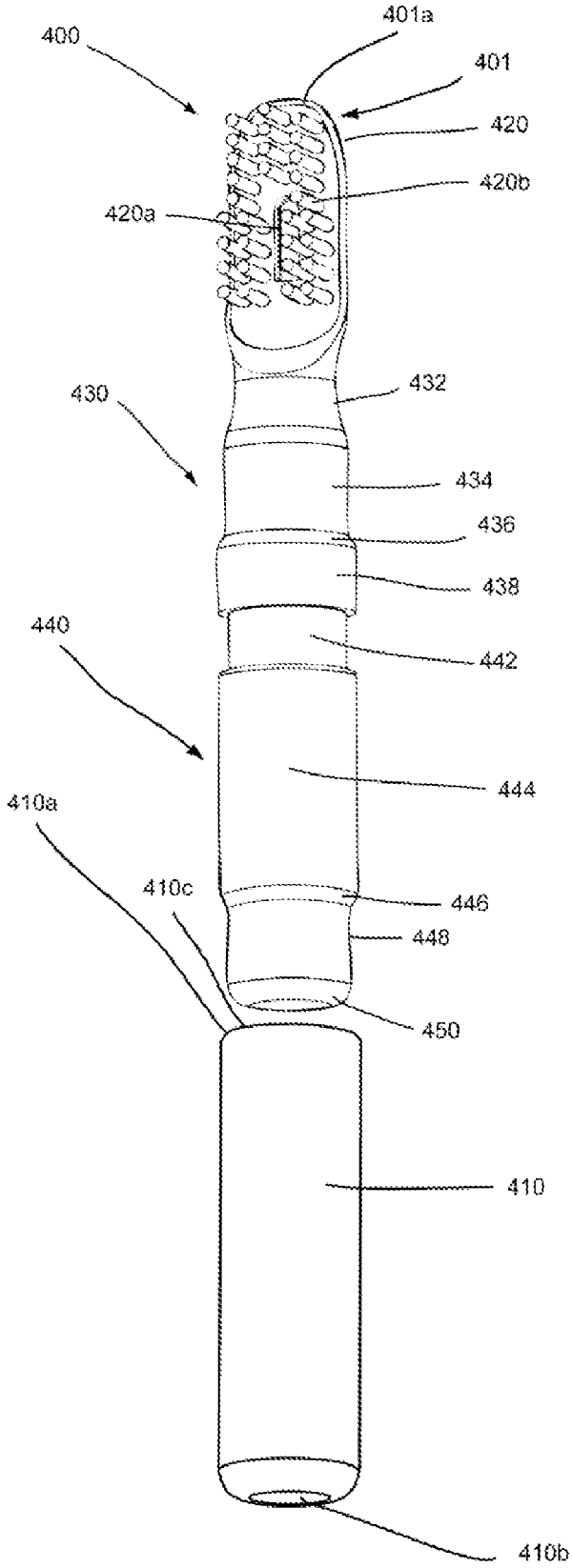
FIG. 17 shows a perspective view of the apparatus of FIG. 15 along with a cover.

FIG. 17 shows a perspective view of an apparatus 400 in accordance with another embodiment of the present invention. The apparatus 400 includes the device 401 and a cover 410. The cover 410 includes a first end 410*a* and a second end 410*b*. An opening 410*c* is located at the first end 410*a*.

Similar to the embodiment of FIGS. 13-14, the cover 410 can be placed so that the top end 401*a* of the device 401 has been inserted into the opening 410*c* at end 410*a* of the cover 410. The cover 410 can be slid over part of the device 401 so that the cover 410 covers the head piece 420, and sections 432 and 434 of the pushing cap 430.

The cover 410 can also be slid over the bottom end 401*b* of the device 401, so that the end 401*b* is inserted into the opening 410*c* at the end 410*a* of the cover 410. The cover 410 can be slid over the bottom end 401*b* until the cover 410 covers sections 450, and 448, and thereby provides an elongated handle for the device 401 and the apparatus 400.

Section 448 of the container 440, has an outer diameter which is typically slightly less than an inner diameter of the typically circular opening 410*c* of the cover 410, which allows the cover 410 to be placed over the section 450, to act as a handle or to extend the length of a handle including sections 444, 446, 448, and 450.

The combination of the pushing cap 330 and the container 340 may be considered a body piece, section, or portion. Similarly the combination of the pushing cap 430 and the container 440 may be considered a body piece, section or portion.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a cover;

a housing, wherein a tooth brush is fixed to the housing;

a pushing cap;

a container;

and a seal; and wherein the container is adaptable for retaining a solvent, and the combination of the seal and the container are adapted to retain the solvent in a completely enclosed chamber, wherein the seal is adapted to prevent the solvent from coming out of the container unless the seal is broken;

wherein the cover is configured so that it can be oriented with respect to the pushing cap so that when the cover is pressed in a first direction, the pushing cap moves in the first direction, and snaps into a first position on the container while breaking the seal, allowing the solvent to come out of the container and out of the housing;

wherein the pushing cap is comprised of a top section and a bottom section, wherein the top section and the bottom section come together at a shoulder;

wherein the cover is configured so that it can be placed over the pushing cap so that the cover substantially surrounds the top section, the cover rests on the shoulder, and the cover when pressed in the first direction, presses on the shoulder and thereby moves the pushing cap in the first direction.

2. The apparatus of claim 1 further comprising the solvent.

3. The apparatus of claim 2 wherein the solvent is a teeth whitener.

4. The apparatus of claim 2 wherein the solvent is tooth paste.

5. The apparatus of claim 1 wherein the container is configured so that it is a handle for using the apparatus as a tooth brush;

the cover is adapted so that it can be placed over a portion of the container to form a modified handle for using the apparatus as a tooth brush; and wherein the modified handle is comprised of the cover and the container, and the modified handle is substantially longer than the handle.

6. The apparatus of claim 1 wherein the cover can be separated from the pushing cap by pulling the cover in a second direction which is opposite the first direction.

7. The apparatus of claim 1 wherein the pushing cap has a pointed section which breaks the seal when the pushing cap is moved in the first direction.

8. The apparatus of claim 7 wherein the pointed section is located substantially in the center of the pushing cap.

9. The apparatus of claim 8 the pointed section is surrounded by one or more openings through which the solvent can pass to go from the container to the housing.

10. The apparatus of claim 1 further comprising means for holding the pushing cap in a first position with respect to the container prior to the seal being broken;

means for holding the pushing cap in a second position with respect to the container, which is different from the first position, after the seal has been broken;

wherein the means for holding the pushing cap in the first position include a first means which is part of the pushing cap and a second means which is part of the container, wherein the first means and the second means fit together; and wherein the means for holding the pushing cap in the second position include a third means which is part of the pushing cap and a fourth means which is part of the container, wherein the third means and the fourth means fit together.

11. The apparatus of claim 10 wherein the first means is a ridge;

the second means is an indentation;

the third means is a ridge;

and the fourth means is an indentation.

12. The apparatus of claim 10 wherein the first means is an indentation;

the second means is a ridge;

the third means is an indentation;

and the fourth means is a ridge.

* * * * *